US011450521B2

(12) United States Patent
Shchemelinin

(10) Patent No.: US 11,450,521 B2
(45) Date of Patent: Sep. 20, 2022

(54) LASER SUSTAINED PLASMA LIGHT SOURCE WITH HIGH PRESSURE FLOW

(71) Applicant: KLA Corporation, Milpitas, CA (US)

(72) Inventor: Anatoly Shchemelinin, Bozeman, MT (US)

(73) Assignee: KLA Corporation, Milpitas, CA (US)

( * ) Notice: Subject to any disclaimer, the term of this patent is extended or adjusted under 35 U.S.C. 154(b) by 0 days.

(21) Appl. No.: 17/157,782

(22) Filed: Jan. 25, 2021

(65) Prior Publication Data

US 2021/0242009 A1 Aug. 5, 2021

Related U.S. Application Data

(60) Provisional application No. 62/970,287, filed on Feb. 5, 2020.

(51) Int. Cl.

| | |
|---|---|
| ***H01J 61/02*** | (2006.01) |
| ***H01J 61/16*** | (2006.01) |
| ***H01J 61/52*** | (2006.01) |
| ***H01J 61/28*** | (2006.01) |

(52) U.S. Cl.

CPC ..... *H01J 61/025* (2013.01); *H01J 61/16* (2013.01); *H01J 61/28* (2013.01); *H01J 61/52* (2013.01)

(58) Field of Classification Search

CPC ..... H01J 61/025; H01J 61/16; H01J 61/28; H01J 61/52; H01J 65/04

See application file for complete search history.

(56) References Cited

U.S. PATENT DOCUMENTS

| | | | | |
|---|---|---|---|---|
| 5,608,526 | A | 3/1997 | Piwonka-Corle et al. | |
| 5,999,310 | A | 12/1999 | Shafer et al. | |
| 6,297,880 | B1 | 10/2001 | Rosencwaig et al. | |
| 7,525,649 | B1 | 4/2009 | Leong et al. | |
| 9,099,292 | B1 | 8/2015 | Bezel et al. | |
| 10,690,589 | B2 | 6/2020 | Bezel et al. | |
| 2007/0002465 | A1 | 1/2007 | Chuang et al. | |
| 2009/0140651 | A1* | 6/2009 | Hori | H01J 61/28 313/631 |
| 2009/0180176 | A1 | 7/2009 | Armstrong et al. | |

(Continued)

OTHER PUBLICATIONS

PCT International Search Report and Written Opinion for International Application No. PCT/US2021/015974 dated May 21, 2021, 8 pages.

*Primary Examiner* — Donald L Raleigh

(74) *Attorney, Agent, or Firm* — Suiter Swantz pc llo

(57) ABSTRACT

A broadband radiation source is disclosed. The source may include a gas containment vessel configured to maintain a plasma and emit broadband radiation. The source may also include a recirculation gas loop fluidically coupled to the gas containment vessel. The recirculation gas loop may be configured to transport gas from one or more gas boosters configured to pressurize the low-pressure gas into a high-pressure gas and transport the high-pressure gas to the recirculation loop via an outlet. The system includes a pressurized gas reservoir fluidically coupled to the outlet of the one or more gas boosters and is configured to receive and store high pressure gas from the one or more gas boosters. The source includes a pressurized gas reservoir located between the one or more gas boosters and the gas containment vessel and is configured to receive and store high pressure gas from the one or more gas boosters.

46 Claims, 7 Drawing Sheets

(56) References Cited

U.S. PATENT DOCUMENTS

| | | | | |
|---|---|---|---|---|
| 2012/0146511 | A1 | 6/2012 | Kuwabara | |
| 2012/0280148 | A1 | 11/2012 | Loopstra et al. | |
| 2013/0114085 | A1 | 5/2013 | Wang et al. | |
| 2016/0163516 | A1 | 6/2016 | Wilson et al. | |
| 2019/0033204 | A1* | 1/2019 | Bezel ..... | H01J 65/042 |

* cited by examiner

LASER SUSTAINED PLASMA LIGHT SOURCE WITH HIGH PRESSURE FLOW

CROSS-REFERENCE TO RELATED APPLICATION

The present application claims the benefit under 35 U.S.C. § 119(e) of U.S. Provisional Application Ser. No. 62/970,287, filed Feb. 5, 2020, which is incorporated herein by reference in the entirety.

TECHNICAL FIELD

The present invention generally relates to plasma-based light sources, and, more particularly, to laser sustained plasma (LSP) light sources with one or more gas boosters for high pressure gas flow.

BACKGROUND

As the demand for integrated circuits having ever-smaller device features continues to increase, the need for improved illumination sources used for inspection of these ever-shrinking devices continues to grow. One such illumination source includes a laser-sustained plasma (LSP) source. Laser-sustained plasma light sources are capable of producing high-power broadband light. Laser-sustained plasma light sources operate by focusing laser radiation into a gas volume in order to excite the gas, such as argon, xenon, neon, nitrogen or mixtures thereof, into a plasma state, which is capable of emitting light. This effect is typically referred to as "pumping" the plasma.

The stability of plasma formed within an LSP light source is partially dependent on gas flows within the chamber housing the plasma. Unpredictable gas flows may introduce one or more variables which may hamper the stability of the LSP light source. By way of example, unpredictable gas flows may distort the plasma profile, distort the optical transmission properties of the LSP light source, and result in uncertainty regarding the position of the plasma itself. Previous approaches used to address unstable gas flows have been unable to achieve sufficiently high gas flow rates to sustain a predictable gas flow. Furthermore, those approaches which are capable of sustaining high gas flow rates introduce unwanted noise, require cumbersome, expensive equipment, and require additional safety management procedures.

Therefore, it would be desirable to provide a system and method that cure one or more shortfalls of the previous approaches identified above.

SUMMARY

A broadband plasma light source is disclosed, in accordance with one or more embodiments of the present disclosure. In one embodiment, the light source includes a pump source configured to generate laser radiation. In another embodiment, the light source includes a gas containment vessel configured to receive laser radiation from the pump source to sustain a plasma within gas flowed through the gas containment vessel, wherein the gas containment vessel is configured to transport gas from an inlet of the gas containment vessel to an outlet of the gas containment vessel, wherein the gas containment vessel is further configured to transmit at least a portion of broadband radiation emitted by the plasma. In another embodiment, the light source includes a recirculation gas loop fluidically coupled to the gas containment vessel, wherein a first portion of the recirculation gas loop is fluidically coupled to the outlet of the gas containment vessel and is configured to receive heated gas or a plume from the plasma from the outlet of the gas containment vessel. In another embodiment, the light source includes one or more gas boosters, wherein the one or more gas boosters are fluidically coupled to the recirculation gas loop, wherein an inlet of the one or more gas boosters is configured to receive low pressure gas from the recirculation loop and wherein the one or more gas boosters are configured to pressurize the low-pressure gas into a high-pressure gas and transport the high-pressure gas to the recirculation loop via an outlet, wherein a second portion of the recirculation gas loop is fluidically coupled to the inlet of the gas containment vessel and is configured to transport pressurized gas from the one or more gas boosters to the inlet of the gas containment vessel. In another embodiment, the light source includes a pressurized gas reservoir located between the one or more gas boosters and the gas containment vessel, wherein the pressurized gas reservoir is fluidically coupled to the outlet of the one or more gas boosters and is configured to receive and store high pressure gas from the one or more gas boosters. In another embodiment, the one or more gas boosters of the light source comprise two or more gas boosters. In another embodiment, the light source is integrated within an optical characterization system.

A method is disclosed, in accordance with one or more embodiments of the present disclosure. In one embodiment, the method includes directing laser radiation into a gas containment vessel in order to sustain a plasma within a gas flowing through the gas containment vessel, wherein the plasma emits broadband radiation. In another embodiment, the method includes recirculating the gas through the gas containment vessel via a recirculation gas loop. In another embodiment, the method includes transporting gas from an outlet of the gas containment vessel to an inlet of one or more gas booster assemblies. In another embodiment, the method includes pressurizing the gas within the one or more gas boosters. In another embodiment, the method includes storing the pressurized gas from an outlet of the one or more gas boosters within a pressurized gas reservoir. In another embodiment, the method includes transporting pressurized gas at a selected working pressure from the pressurized gas reservoir to the gas containment vessel.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures.

DETAILED DESCRIPTION

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure. Reference will now be made in detail to the subject matter disclosed, which is illustrated in the accompanying drawings.

Referring generally to FIGS. 1A-4, systems and methods for generating improved gas flow through a laser-sustained plasma (LSP) radiation source are described, in accordance with one or more embodiments of the present disclosure.

The desired working pressure for an LSP radiation source is approximately 100 bar (or higher). The gas flow speed requirements are approximately 1 m/s-10 m/s. For the required gas flow cross-section, these speeds correspond to approximately 5-1000 liters per minute gas flow at 100 bar, which is a high or extremely high flow rate that will generate up to 1 bar pressure drop along pipes for a reasonable mechanical design. Such requirements impart significant requirements on the mechanical design of such a system.

Embodiments of the present disclosure are directed to a recirculation gas loop (e.g., closed recirculation gas loop or open recirculation gas loop) including one or more gas boosters. Additional embodiments of the present disclosure are directed to a recirculation gas loop including multiple gas boosters (e.g., parallel or series configuration) and a high-pressure gas reservoir. The high-pressure gas exhausted from the gas boosters may fill up the pressurized gas reservoir. Pressure of the gas exiting the pressurized gas reservoir may be regulated to stabilize gas pressure and define the working pressure level of the gas as it is transported to a gas containment vessel for plasma generation.

A broadband plasma source that implements controlled gas flow is described in U.S. Pat. No. 9,099,292, issued on Aug. 4, 2015, which is incorporated herein by reference in the entirety. A recirculation gas loop that utilizes natural convection is described in U.S. Pat. No. 10,690,589, issued on Jun. 23, 2020, which is incorporated herein by reference in the entirety.

Figure 1A:
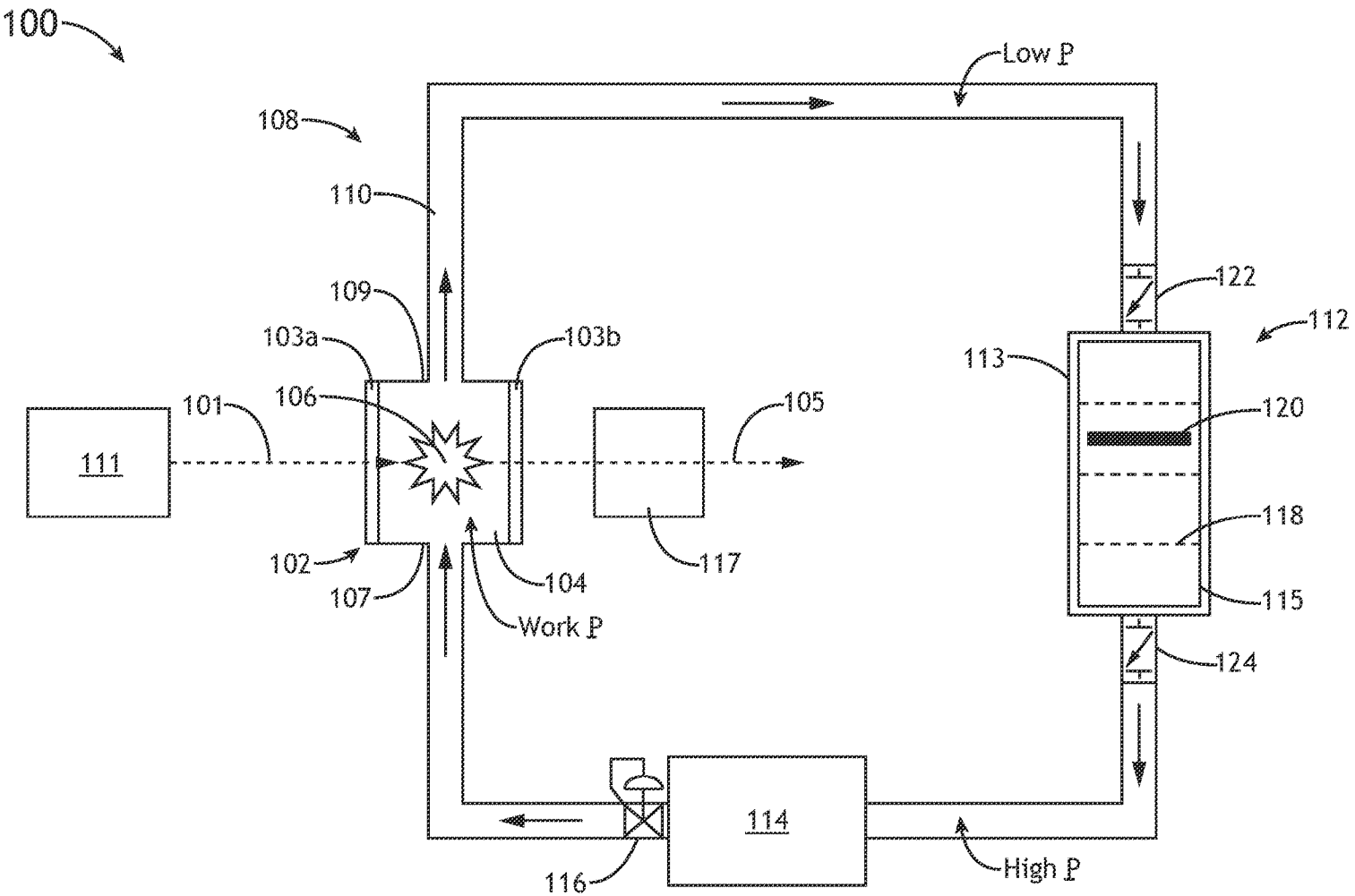
FIG. 1A illustrates a simplified schematic view of a laser sustained plasma (LSP) radiation source including a recirculation gas loop including a gas booster, in accordance with one or more embodiments of the present disclosure.

FIG. 1A illustrates a simplified schematic view of a broadband LSP radiation source 100 in a recirculation configuration, in accordance with one or more embodiments of the present disclosure. In embodiments, LSP radiation source 100 includes a gas containment vessel 102 for maintaining a plasma 106 within a volume of gas 104, a recirculation gas loop 108, pump source 111, and one or more gas boosters 112. In embodiments, the source 100 includes a high-pressure gas reservoir 114.

In embodiments, the recirculation gas loop 108 is fluidically coupled to the gas containment vessel 102. In this regard, a first portion of the recirculation gas loop 108 is fluidically coupled to the outlet 109 of the gas containment vessel 102 and is configured to receive heated gas or a plume from the plasma 106 from the outlet 109 of the gas containment vessel 102. In embodiments, the gas containment vessel 102 is fluidically coupled to a flue 110 via an outlet 109, whereby gas exits the gas containment vessel 102 through outlet 109 into the flue 110. The plume and/or heated gas generated by the plasma 106 may drive gas up through the outlet 109 of the gas containment vessel 102. As gas/plasma plumes are directed up from the gas containment vessel 102, the hot plasma plume is cooled and mixed with the rest of the gas flow and the gas temperature is cooled down to a temperature convenient for handling. At this stage, the gas traveling through the upper arm of recirculation loop 108 is in a low-pressure state (relative to the high-pressure state after boosting).

In embodiments, heated gas travels through the flue 110 to a heat exchanger (not shown). The heat exchanger may include any heat exchanger known in the art including, but not limited to, a water-cooled heat exchanger or a cryogenic heat exchanger (e.g., liquid nitrogen cooled, liquid argon cooled, or liquid helium cooled). In embodiments, the heat exchanger is configured to remove thermal energy from the heated gas within the recirculation gas loop 108. For example, heat exchanger may remove thermal energy from the heated gas within the recirculation gas loop 108 by transferring at least a portion of the thermal energy to a heat sink.

In embodiments, the one or more gas boosters 112 are fluidically coupled to the recirculation gas loop 108. In this regard, an inlet of the one or more gas boosters 112 is configured to receive low pressure gas from the recirculation loop 108. In turn, the one or more gas boosters 112 pressurizes the low-pressure gas into a high-pressure gas and transports the high-pressure gas to the recirculation loop via an outlet. In embodiments, a second portion of the recirculation gas loop 108 is fluidically coupled to the inlet 107 of the gas containment vessel 102 and is configured to transport pressurized gas from the one or more gas boosters 112 to the inlet of the gas containment vessel.

In embodiments, the one or more gas boosters 112 may include a vessel 113 defined by one or more walls 115. For example, the one or more gas boosters 112 may include, but are not limited to, a cylindrical vessel (e.g., cylindrical chamber). In embodiments, the one or more walls 115 of the gas booster vessel 113 may be maintained at a somewhat lower temperature than the temperature of the gas from the inlet of the one or more gas boosters 112.

Figure 1B:
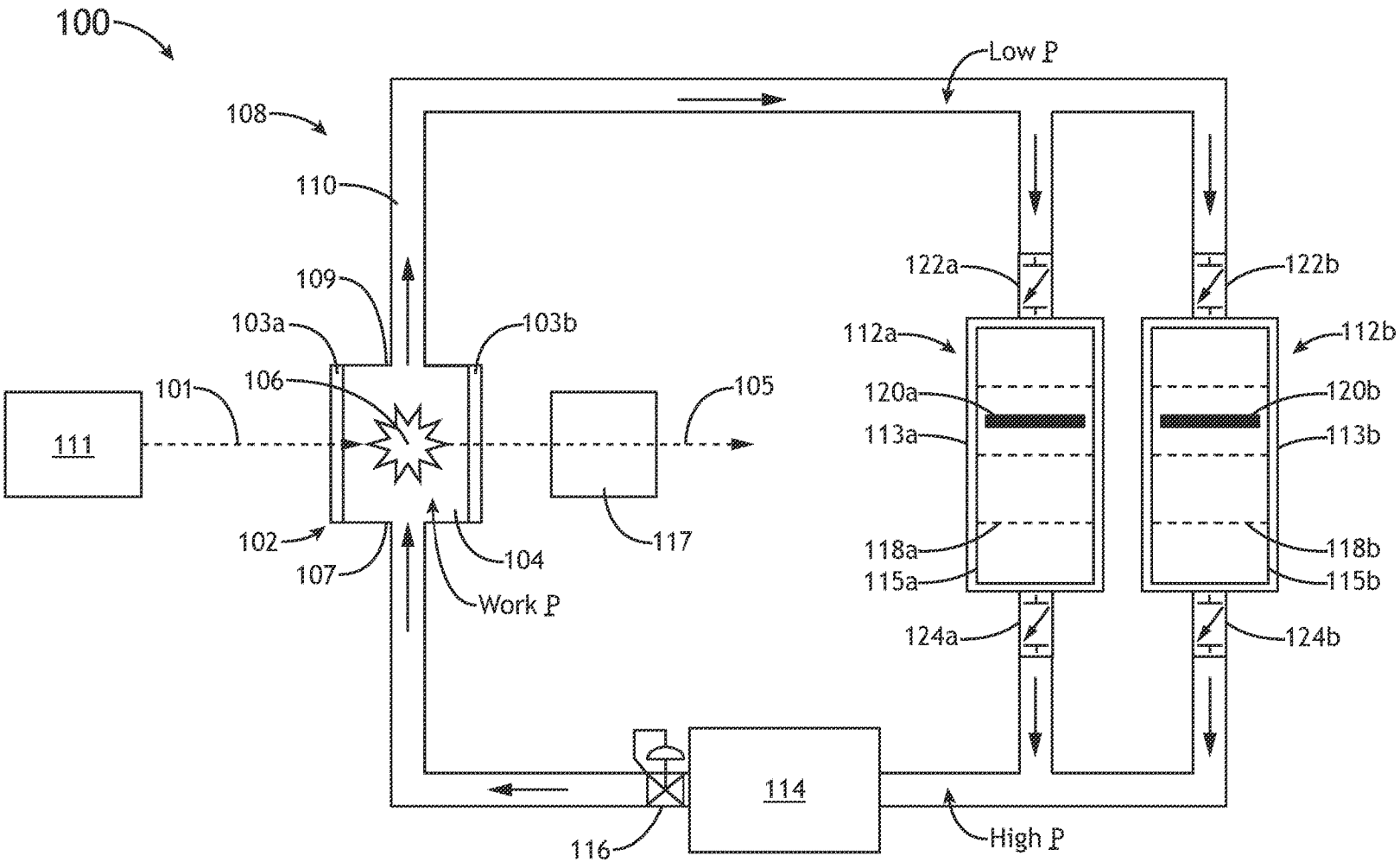
FIG. 1B illustrates a simplified schematic view of a laser sustained plasma (LSP) radiation source including two parallel gas boosters, in accordance with one or more embodiments of the present disclosure.

In embodiments, the one or more gas boosters 112 include one or more heating elements 118. For example, the one or more gas boosters 112 may include multiple low-inertia heating elements 118. As depicted in FIG. 1B, the one or more heating elements 118 may include, but are not limited to, multiple thin-wire grids. In this example, periodic current may be driven through these grids, thereby periodically heating the grids (and surrounding gas) to a high temperature. The temperature may be much higher than the average gas temperature in the vessel 113. For example, in the case of metal wires, the high temperature may reach 1000 degrees.

The one or more heating elements 118 are not limited to thin-wire grids. Rather, it is noted that the scope of the present disclosure may extend to any number of heating configurations. For example, the one or more heating elements 118 may include, but are not limited to, one or more metal wires, a metal grid, and/or a metal mesh configured for generating heat via an electrical current. By way of another example, the one or more heating elements 118 may include, but are not limited to, a structure configured for heating via an external magnetic field. In this example, the one or more heating elements 118 may include an inductive element (e.g., coil) that generates heat in response to an external magnetic field inductively coupled to the inductive element. The magnetic field may be generated via a magnetic field generator located outside of the one or more gas boosters 112. By way of another example, the one or more heating elements 118 may include, but are not limited to, a set of electrodes configured for heating via an electric arc discharge. In this example, the one or more heating elements 118 may include a set of metal electrodes connected to an external electrical power supply. The voltage applied to the electrodes via the external electrical power supply may give rise to an arc discharge between the electrodes. By way of another example, the one or more heating elements 118 may include, but are not limited to, an external optical device configured to focus light into the one or more gas boosters 112. For instance, the external optical device may include, but is not limited to, one or more lasers (e.g., pulsed laser, continuous wave laser, and the like) configured to focus light into the one or more gas boosters 112. By way of another example, the one or more heating elements 118 may include, but are not limited to, an external electromagnetic radiation source configured to direct electromagnetic radiation into the one or more gas boosters 112. For instance, the external electromagnetic radiation source may include, but is not limited to, one or more microwave or radio-frequency (RF) emitters configured to direct microwave/RF radiation into the one or more gas boosters 112.

In embodiments, the one or more gas boosters 112 include one or more agitators 120. In the case of an internal conductive heating mechanism, the one or more agitators 120 may improve heat exchange between the one or more heating elements 118 (e.g., coil, grid, etc.) and the cooler walls 115 of the vessel 113. In embodiments, walls 115 of the vessel 113 are maintained at a cooler temperature than the incoming case flow and, as the one or more heating elements 118 are switched ON/OFF periodically, the gas temperature (and pressure) within the vessel 113 oscillate.

In embodiments, the one or more agitators 120 may include an active externally powered agitator. The active externally powered agitator may be configured for magnetic or mechanical coupling. In embodiments, the one or more agitators 120 may include a turbine-powered agitator. In this example, the turbine may be rotated by the gas flow agitator itself and can be integrated with the turbine or can be a stand-alone separated component. In the case when agitator is separated from the turbine component, it can be either mechanically or magnetically coupled with the turbine. In embodiments, the one or more agitators 120 may include some fixed components (e.g., one or more deflecting fins) located within the gas flow of the recirculation gas loop 108. For example, the one or more agitators 120 may include, but are not limited to, one or more fixed deflector components (e.g., fins) located within the gas flow of the recirculation gas loop 108. In alternative embodiments, the source 100 may operate with no agitators.

In embodiments, the source 100 includes a pressurized gas reservoir 114 located between the one or more gas boosters 112 and the gas containment vessel 102. The pressurized gas reservoir 114 may be fluidically coupled to the outlet of the one or more gas boosters 112 and is configured to receive and store high-pressure gas from the one or more gas boosters 112. Gas from the outlet of the gas booster 112 may fill up the pressurized gas reservoir 114. As the gas from the gas booster 112 travels from the outlet of the gas booster 112 to the inlet of the pressurized gas reservoir 114, the gas is cooled (or warmed) to the required working temperature.

As the gas in the booster vessel 113 is heated up, the pressure in the booster vessel 113 increases. In embodiments, the gas booster 112 includes an intake check valve 122 and an exhaust check valve 124. In embodiments, the intake check valve 122 prevents gas from rising and flowing backward into the gas containment vessel 102. As vessel pressure exceeds pressure in the high-pressure portion of the recirculation gas loop 108, the gas flows out through exhaust check valve 124 and fills up the pressurized gas reservoir 114. It is noted that, when the one or more heating elements 118 of the gas booster 112 are turned off, the one or more heaters 118 rapidly cool to the temperature of the surrounding gas. The gas continues to cool down through the conduction of heat to the cooler walls 115 of the vessel 113. As the temperature drops, pressure of the gas also drops and a new portion of warm gas enters the vessel 113 via the intake check valve 122.

As noted, the gas pressure in the pressurized gas reservoir 114 may vary, or oscillate, above a working pressure of the gas containment vessel 102 due to varying heating profile of heaters 118. In embodiments, the recirculation gas loop 108 includes a pressure regulator 116 fluidically coupled to an outlet of the pressurized gas reservoir 114. The pressure regulator 116 is configured to stabilize an output pressure of the pressurized gas reservoir 114 such that the gas containment vessel 102 receives a continuous gas flow. In this manner, the pressure regulator 116 may establish the working pressure (Work P) level of the gas containment vessel 102.

In embodiments, the source 100 may include one or more additional pressurized gas reservoirs (not shown). For example, for further stabilization of Work P and flow, and additional reservoir can be added to the low-pressure part of the system. The additional reservoir may incorporate a pressure regulator (e.g., back pressure regulator) or flow control valve.

It is noted that the scope of the present disclosure is not limited to the configuration or the single gas booster depicted in FIG. 1A. Rather, the scope of the present disclosure may be extended to a source 100 including multiple gas boosters with various designs.

FIG. 1B illustrates a simplified schematic view of the LSP radiation source 100 including two gas boosters arranged in a parallel configuration in the recirculation loop 108, in accordance with one or more embodiments of the present disclosure. It is noted that the description associated with the embodiments of FIG. 1A described previously herein should be interpreted to extend to the embodiment of FIG. 1B unless otherwise noted.

In embodiments, the recirculation loop 108 includes a first gas booster 112*a* and a second gas booster 112*b* fluidically coupled in parallel to the recirculation gas loop 108. In this regard, the first gas booster 112*a* and the second gas booster

Figure 1C:
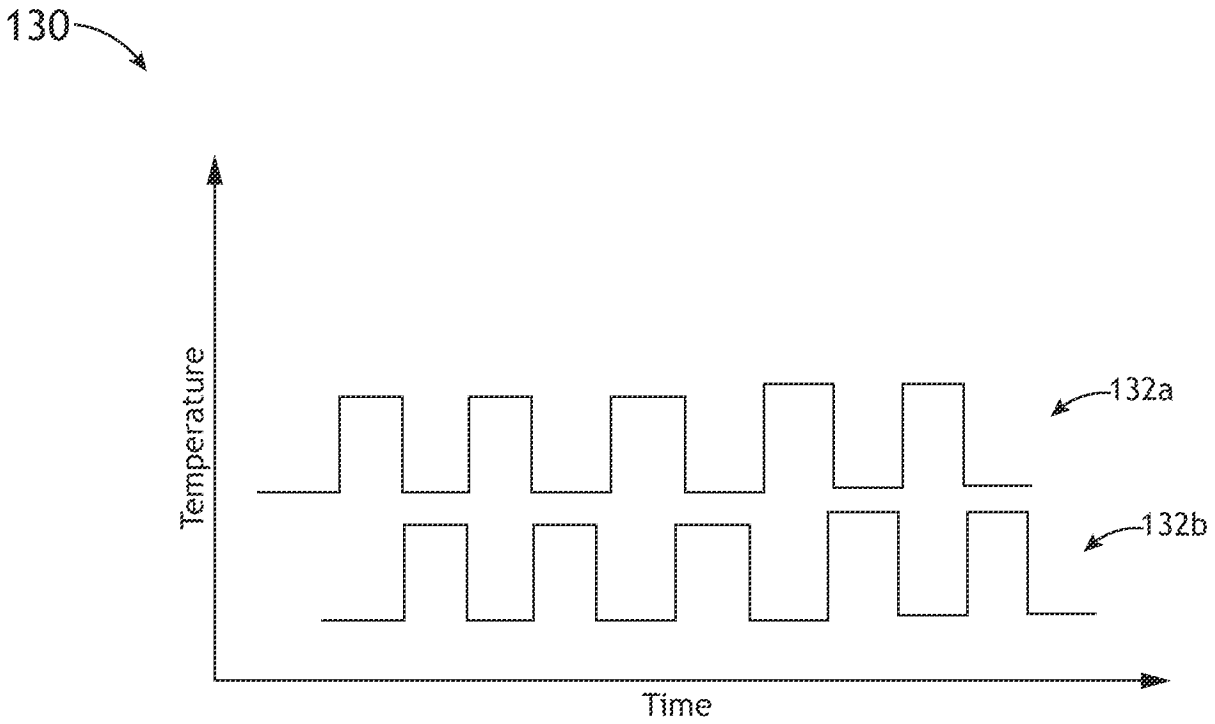
FIG. 1C illustrates a conceptual view depicting the heating cycles of two parallel gas boosters, in accordance with one or more embodiments of the present disclosure.

112*b* are configured to receive gas from the gas containment vessel 102. In this regard, the first gas booster 112*a* operates in the same manner as the gas booster 112 described with respect to FIG. 1A. In this embodiment, the second gas booster 112*b* operates in the same manner as 112*a*, but with a shifted pressure oscillation phase. This phase shift in the pressure output between the first and second gas boosters 112*a*, 112*b* serves to smooth boosting operation. FIG. 1C depicts a conceptual view of a heating profile (temperature vs. time) 130, which gives rise to a phase shift between the pressure outputs of the gas boosters. In this regard, curve 132*a* represents the temperature vs. time relationship for gas booster 112*a*, while curve 132*b* represents the temperature vs. time relationship for gas booster 112*b*. The offset between curve 132*a* and curve 132*b* leads to a smoother pressure vs. time relationship for the combined output of the boosters 112*a*, 112*b*, which flows into the pressurized gas reservoir 114. It is noted that while FIG. 1B depicts two gas boosters 112*a*, 112*b* this should not be interpreted as a limitation of the scope of the present disclosure. The source 100 may include any number of gas boosters. In this case, the phases of heating and cooling may be evenly distributed across the number gas boosters.

In embodiments, the gas boosters 112*a*, 112*b* include vessels 113*a*, 113*b* respectively. The vessels 113*a*, 113*b* may include any of the variations of vessel 113 described previously herein. In this embodiment, the walls 115*a*, 115*b* of the gas booster vessels 113*a*, 113*b* may be maintained at a somewhat lower temperature than the temperature of the gas from the inlet of the gas boosters 112*a*, 112*b*.

In embodiments, the gas boosters 112*a*, 112*b* include first and second heating elements 118*a*, 118*b* respectively. The heating elements 118*a*, 118*b* may include any of the variations of heating elements 118 described previously herein.

In embodiments, the gas boosters 112*a*, 112*b* include first and second agitators 120*a*, 120*b* respectively. The agitators 120*a*, 120*b* may include any of the variations of agitators 120 described previously herein. In embodiments, walls 115*a*, 115*b* of the vessels 113*a*, 113*b* are maintained at a cooler temperature than the incoming case flow and, as heating elements 118*a*, 118*b* are turned ON/OFF periodically, the gas temperature (and pressure) within the vessels 113*a*, 113*b* oscillate in the offset fashion depicted in FIG. 1C.

Gas from the outlet of the gas boosters 112*a*, 112*b* fills up the pressurized gas reservoir 114. As the gas travels from the outlet of the gas boosters 112*a*, 112*b* to the inlet of the pressurized gas reservoir 114, the gas is cooled (or warmed) to the required working temperature.

As the gas in the booster vessels 113*a*, 113*b* is heated up, the pressure in the booster vessels 113*a*, 113*b* increases. In embodiments, the gas boosters 112*a*, 112*b* include intake check valves 122*a*, 122*b* and exhaust check valves 124*a*, 124*b*. In embodiments, the intake check valves 122*a*, 122*b* prevent gas from rising and flowing backward into the gas containment vessel 102. As cylinder pressure exceeds pressure in high-pressure portion of the recirculation gas loop 108, the gas flows out of the vessels 113*a*, 113*b* through exhaust check valves 124*a*, 124*b*, in an offset fashion, and fills up pressurized gas reservoir 114. Again, the pressure regulator 116 of the gas reservoir 114 is configured to stabilize an output pressure of the pressurized gas reservoir 114 such that the gas containment vessel 102 receives a continuous gas flow. In this manner, the regulator 114 may establish the Work P level of the gas containment vessel 102.

It is noted that, when the heating elements 118*a*, 118*b* of the gas boosters 112*a*, 112*b* are turned off, the heating elements 118*a*, 118*b* rapidly cool to the temperature of the surrounding gas. The gas continues to cool down through the conduction of heat to the cooler walls 115*a*, 115*b* of the vessels 113*a*, 113*b*. As the temperature drops, pressure of the gas also drops and a new portion of warm gas enters the vessels 113*a*, 113*b* via the intake check valves 122*a*, 122*b* in a phase-shifted fashion.

It is noted that the scope of the present disclosure is not limited to the heating element arrangement depicted in FIGS. 1A and 1B, which are provided merely for illustration. It is noted that any heating/cooling arrangement that produces a difference in temperature between the gas and the walls 115 of the gas booster(s) 112 may be implemented in the embodiments of the present disclosure. In embodiments, the gas boosters 112 (or 112*a*, 112*b*) may include one or more active cooling elements to create a larger temperature difference between the heated gas and the walls 115. For example, the gas boosters 112 may include a cold finger. In embodiments, common components may be used for both heating and cooling within the gas booster 112, whereby the heating and cooling phases are alternated.

In alternative embodiments, the heating elements 118 of the gas boosters 112 (or 112*a*, 112*b*) may be replaced by active cooling elements. For example, the gas boosters 112 may include a cold finger to cool the gas within the gas boosters 112 relative to hot walls 115 of the gas boosters 112. The use of low-inertia active cooling elements may improve the operation of the source 100. Again, any arrangement suitable for periodically heating/cooling the gas within the gas boosters 112 may be implemented within the source 100.

Figure 1D:
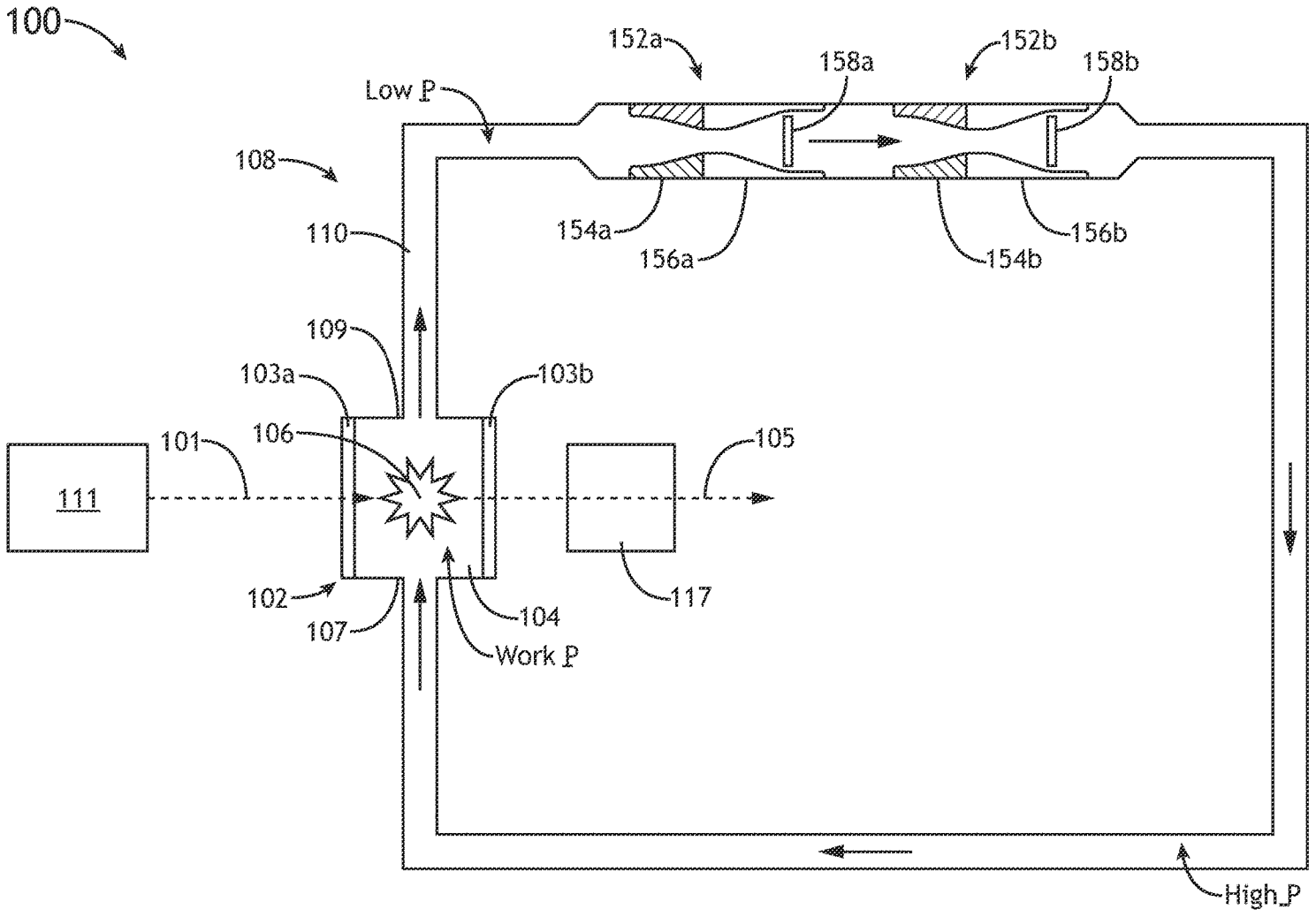
FIG. 1D illustrates a simplified schematic view of a LSP radiation source including two series gas boosters, in accordance with one or more embodiments of the present disclosure.

FIG. 1D illustrates a simplified schematic view of a LSP radiation source including two series gas boosters, in accordance with one or more embodiments of the present disclosure. It is noted that the description associated with the embodiments of FIGS. 1A-1C described previously herein should be interested to extend to the embodiment of FIG. 1D unless otherwise noted.

In embodiments, the recirculation loop 108 includes a first gas booster 152*a* and a second gas booster 152*b* fluidically coupled in series to the recirculation gas loop 108. The first gas booster 152*a* is configured to receive gas from the gas containment vessel 102 and the second gas booster 152*b* is configured to receive heated gas from the first gas booster 152*a*.

In embodiments, the first and second gas booster 152*a*, 152*b* are jet gas boosters. For example, the first gas booster 152*a* includes a first intake nozzle 154*a* and an output nozzle 156*a* and the second gas booster 152*b* includes a second intake nozzle 154*b* and an output nozzle 156*b*. The intake nozzle 154*a* is at a lower temperature than the output nozzle 156*a* and the intake nozzle 154*b* is at a lower temperature than the output nozzle 156*b*. The gas of the recirculation gas loop 108 is accelerated through the loop 108 by the temperature difference between the cold intake nozzles 154*a*, 154*b* and the hot output nozzles 156*a*, 156*b*.

In embodiments, warm gas exhausting first booster 152*a* cools down via the walls of the recirculation loop 108 and the cold intake nozzle 154*b* of the second gas booster 152*b*.

In embodiments, the gas boosters 152*a*, 152*b* include agitators 158*a*, 158*b* respectively. The agitators serve to increase heat exchange between the gas and hot nozzles 156*a*, 156*b*. In embodiments, an additional agitator (not shown) may be added to each booster 152*a*, 152*b* to improve cooling. The agitators 158*a*, 158*b* may include, but are not limited to, floating magnets, turbines, or fixed deflectors.

It is further noted that as gas exits the second gas booster 152*b* it should be cooled down to the working temperature necessary for the gas containment vessel 102.

In embodiments, when being turned on, the source 100 may utilize a seed flow to start operation. There are several ways of generating such flow including, but not limited to, use of natural convection. Natural convention in the context of a recirculation gas loop in a broadband plasma source is discussed in U.S. Pat. No. 10,690,589, which is previously incorporated above.

The jet booster design depicted in FIG. 1D is particularly advantageous because it provides a simpler design that does not require valves or moving parts. In addition, the gas flow within the recirculation loop 108 is accelerated uniformly in time. The jet-based design of FIG. 1D does not require a pressurized gas reservoir and pressure/flow control regulators. Without regulators and valves, the total pressure drop along the gas path can be significantly reduced. Without reservoirs and cylinders, total gas volume can be significantly reduced as well, which represents a significant advantage for handling and safety of high-pressure system.

It is noted that while the jet-based design of FIG. 1D does not require the use of a pressurized gas reservoir and pressure regulation this should not be interpreted as a limitation on the scope of the present disclosure. In embodiments, the jet-based configuration of system 100 may include a pressurized gas reservoir and pressure regulator such as those depicted in FIGS. 1A-1C. The pressurized gas reservoir and pressure regulator may be used to mitigate jet instabilities within the recirculation loop 108.

Referring generally to FIGS. 1A-1D, in embodiments, the pump source 111 is configured to generate a pump beam 101 (e.g., laser radiation 101). Pump beam 101 may include radiation of any wavelength or wavelength range known in the art including, but not limited to, infrared (IR) radiation, near infrared (NIR) radiation, ultraviolet (UV) radiation, visible radiation, and the like.

In embodiments, the pump source 111 directs the pump beam 101 into the gas containment vessel 102. For example, the gas containment vessel 102 may include any gas containment vessel known in the art including, but not limited to, a plasma lamp, a plasma cell, plasma chamber, and the like. By way of another example, the gas containment vessel 102 may include, but is not limited to, a plasma bulb. In embodiments, the gas containment vessel 102 may include one or more transmissive elements 103*a*. The one or more transmissive elements 103*a* may transmit the pump beam 101 into a volume of gas 104 contained within gas containment vessel 102 so as to generate and/or sustain a plasma 106. For example, the one or more transmissive elements 103*a* may include, but are not limited to, one or more transmissive ports, one or more windows, and the like.

In embodiments, the LSP source 100 may include one or more pump illumination optics (not shown). The one or more pump illumination optics may include any optical element known in the art for directing and/or focusing the pump beam 101 into the gas containment vessel 102 including, but not limited to, one or more lenses, one or more mirrors, one or more beam splitters, one or more filters, and the like.

The focusing of the pump beam 101 into the volume of gas 104 causes energy to be absorbed through one or more absorption lines of the gas and/or plasma 106 contained within the volume of gas 104, thereby "pumping" the gas in order to generate and/or sustain the plasma 106. For example, pump beam 101 may be directed and/or focused (e.g., by pump source and/or one or more pump illumination optics) to one or more focal points within the volume of gas 104 contained within gas containment vessel 102 in order to generate and/or sustain a plasma 106. It is noted herein that the LSP radiation source 100 may include one or more additional ignition sources used to facilitate the generation of the plasma 106 without departing from the spirit or scope of the present disclosure. For example, gas containment vessel 102 may include one or more electrodes which may initiate the plasma 106.

In embodiments, the plasma 106 generates broadband radiation 105. In embodiments, the radiation 105 generated by the plasma 106 exits the gas containment vessel 102 via one or more additional transmissive elements 103*b*. The one or more additional transmissive elements 103*b* may include, but are not limited to, one or more transmissive ports, one or more windows, and the like. It is noted herein that the one or more transmissive elements 103*a* and the one or more additional transmissive elements 103*b* may comprise the same transmissive element, or may comprise separate transmissive elements. By way of example, where the gas containment vessel 102 includes a plasma lamp or a plasma bulb, the one or more transmissive elements 103*a* and the one or more additional transmissive elements 103*b* may comprise a single transmissive element.

In embodiments, LSP radiation source 100 includes a set of collection optics 117. The set of collection optics 117 may include one or more optical elements known in the art configured to collect and/or focus radiation (e.g., radiation 105) including, but not limited to, one or more mirrors, one or more prisms, one or more lenses, one or more diffractive optical elements, one or more parabolic mirrors, one or more elliptical mirrors, and the like. It is recognized herein that the set of collection optics 117 may be configured to collect and/or focus radiation 105 generated by plasma 106 to be used for one or more downstream processes including, but not limited to, imaging processes, inspection processes, metrology processes, lithography processes, and the like.

In embodiments, the gas recirculated through the recirculation gas loop 108 may include, but is not limited to, argon, xenon, neon, nitrogen, krypton, helium or mixtures thereof. By further way of example, the gas recirculated through the recirculation gas loop 108 may include a mixture of two or more gasses. It is noted herein that enhanced, fast-flow gas within gas containment vessel 102 may promote stable plasma 106 generation. In a similar regard, it is noted herein that stable plasma 106 generation may generate radiation 105 with one or more substantially constant properties.

In embodiments, pump source 111 may include one or more lasers. In a general sense, pump source 111 may include any laser system known in the art. For instance, the pump source 111 may include any laser system known in the art capable of emitting radiation in the infrared, visible or ultraviolet portions of the electromagnetic spectrum. In embodiments, the pump source 111 may include a laser system configured to emit continuous wave (CW) laser radiation. For example, the pump source 102 may include one or more CW infrared laser sources. For instance, in settings where the gas within the gas containment structure 105 is or includes argon, the pump source 111 may include a CW laser (e.g., fiber laser or disc Yb laser) configured to emit radiation at 1069 nm. It is noted that this wavelength fits to a 1068 nm absorption line in argon and as such is particularly useful for pumping argon gas. It is noted herein that the above description of a CW laser is not limiting, and any laser known in the art may be implemented in the context of the present invention.

In embodiments, the pump source 111 may include one or more diode lasers. For example, the pump source 111 may include one or more diode lasers emitting radiation at a wavelength corresponding with any one or more absorption lines of the species of the gas contained within the gas containment vessel 102. In a general sense, a diode laser of pump source 111 may be selected for implementation such that the wavelength of the diode laser is tuned to any absorption line of any plasma 106 (e.g., ionic transition line) or any absorption line of the plasma-producing gas (e.g., highly excited neutral transition line) known in the art. As such, the choice of a given diode laser (or set of diode lasers) will depend on the type of gas contained within the gas containment vessel 102 of LSP radiation source 100.

In embodiments, the pump source 111 may include an ion laser. For example, the pump source 102 may include any noble gas ion laser known in the art. For instance, in the case of an argon-based plasma, the pump source 111 used to pump argon ions may include an Ar+ laser.

In embodiments, the pump source 111 may include one or more frequency converted laser systems. For example, the pump source 111 may include a Nd:YAG or Nd:YLF laser having a power level exceeding 100 watts. In embodiments, the pump source 111 may include a broadband laser. In embodiments, the pump source 111 may include a laser system configured to emit modulated laser radiation or pulsed laser radiation.

In embodiments, the pump source 111 may include one or more lasers configured to provide laser light at a substantially constant power to the plasma 106. In embodiments, the pump source 111 may include one or more modulated lasers configured to provide modulated laser light to the plasma 106. In embodiments, the pump source 111 may include one or more pulsed lasers configured to provide pulsed laser light to the plasma 106.

In embodiments, the pump source 111 may include one or more non-laser sources. In a general sense, the pump source 111 may include any non-laser light source known in the art. For instance, the pump source 111 may include any non-laser system known in the art capable of emitting radiation discretely or continuously in the infrared, visible or ultraviolet portions of the electromagnetic spectrum.

In embodiments, the pump source 111 may include two or more light sources. In embodiments, the pump source 111 may include two or more lasers. For example, the pump source 111 (or "sources") may include multiple diode lasers. By way of another example, the pump source 111 may include multiple CW lasers. In embodiments, each of the two or more lasers may emit laser radiation tuned to a different absorption line of the gas or plasma 106 within the gas containment vessel 102. In this regard, the multiple pulse sources may provide illumination of different wavelengths to the gas within the gas containment vessel 102.

Figure 2:
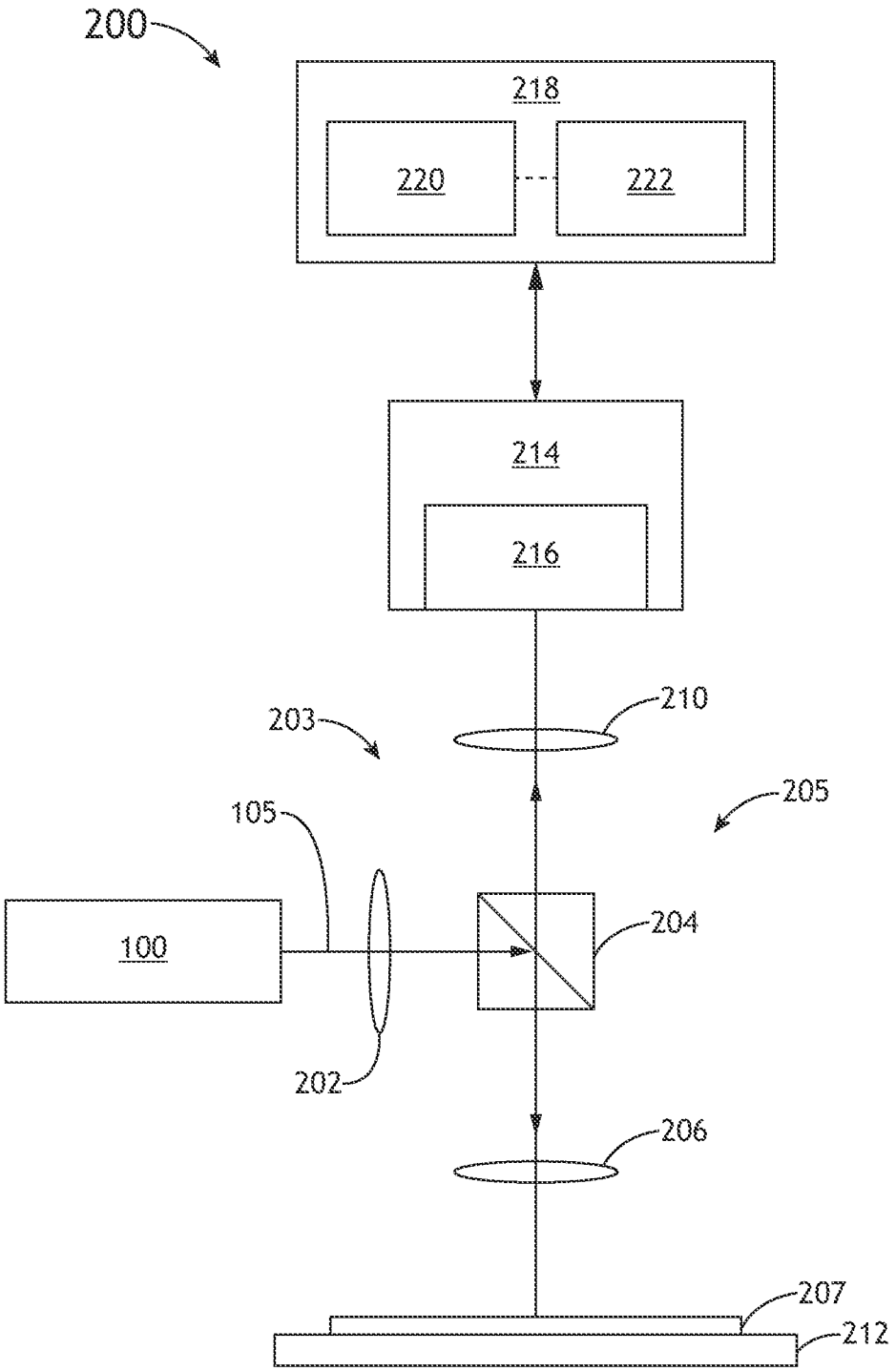
FIG. 2 illustrates a simplified schematic view of an optical characterization system implementing the LSP radiation source with one or more gas boosters, in accordance with one or more embodiments of the present disclosure.

FIG. 2 illustrates a simplified schematic view of an optical characterization system 200 implementing the LSP radiation source 100, in accordance with one or more embodiments of the present disclosure. In embodiments, system 200 includes the LSP radiation source 100, an illumination arm 203, a collection arm 205, a detector assembly 214, and a controller 218 including one or more processors 220 and memory 222.

System 200 may comprise any characterization or fabrication system known in the art including, but not limited to, an imaging, inspection, metrology, or lithography system. In this regard, system 200 may be configured to perform inspection, optical metrology, lithography, and/or any form of imaging on a sample 207. Sample 207 may include any sample known in the art including, but not limited to, a semiconductor wafer, a reticle/photomask, and the like. It is noted that system 200 may incorporate one or more of the various embodiments of the LSP radiation source 100 described throughout the present disclosure.

In embodiments, sample 207 is disposed on a stage assembly 212 to facilitate movement of sample 207. Stage assembly 212 may include any stage assembly 212 known in the art including, but not limited to, an X-Y stage, an R-θ stage, and the like. In embodiments, stage assembly 212 is capable of adjusting the height of sample 207 during inspection or imaging to maintain focus on the sample 207.

In embodiments, the illumination arm 203 is configured to direct radiation 105 from the LSP radiation source 100 to the sample 207. The illumination arm 203 may include any number and type of optical components known in the art. In embodiments, the illumination arm 203 includes one or more optical elements 202, a beam splitter 204, and an objective lens 206. In this regard, illumination arm 203 may be configured to focus radiation 105 from the LSP radiation source 100 onto the surface of the sample 207. The one or more optical elements 202 may include any optical element or combination of optical elements known in the art including, but not limited to, one or more mirrors, one or more lenses, one or more polarizers, one or more gratings, one or more filters, one or more beam splitters, and the like.

In embodiments, the collection arm 205 is configured to collect light reflected, scattered, diffracted, and/or emitted from sample 207. In embodiments, collection arm 205 may direct and/or focus the light from the sample 207 to a sensor 216 of a detector assembly 214. It is noted that sensor 216 and detector assembly 214 may include any sensor and detector assembly known in the art. The sensor 216 may include, but is not limited to, a charge-coupled device (CCD) detector, a complementary metal-oxide semiconductor (CMOS) detector, a time-delay integration (TDI) detector, a photomultiplier tube (PMT), an avalanche photodiode (APD), and the like. Further, sensor 216 may include, but is not limited to, a line sensor or an electron-bombarded line sensor.

In embodiments, detector assembly 214 is communicatively coupled to a controller 218 including one or more processors 220 and memory 222. For example, the one or more processors 220 may be communicatively coupled to memory 222, wherein the one or more processors 220 are configured to execute a set of program instructions stored on memory 222. In embodiments, the one or more processors 220 are configured to analyze the output of detector assembly 214. In embodiments, the set of program instructions are configured to cause the one or more processors 220 to analyze one or more characteristics of sample 207. In embodiments, the set of program instructions are configured to cause the one or more processors 220 to modify one or more characteristics of system 200 in order to maintain focus on the sample 207 and/or the sensor 216. For example, the one or more processors 220 may be configured to adjust the objective lens 206 or one or more optical elements 202 in order to focus radiation 105 from LSP radiation source 100 onto the surface of the sample 207. By way of another example, the one or more processors 220 may be configured to adjust the objective lens 206 and/or one or more optical elements 210 in order to collect illumination from the surface of the sample 207 and focus the collected illumination on the sensor 216.

It is noted that the system 200 may be configured in any optical configuration known in the art including, but not limited to, a dark-field configuration, a bright-field orientation, and the like.

It is noted herein that the one or more components of system 100 may be communicatively coupled to the various other components of system 100 in any manner known in the art. For example, the LSP radiation source 100, detector assembly 214, controller 218, and one or more processors 220 may be communicatively coupled to each other and other components via a wireline (e.g., copper wire, fiber optic cable, and the like) or wireless connection (e.g., RF coupling, IR coupling, data network communication (e.g., WiFi, WiMax, Bluetooth and the like).

Figure 3:
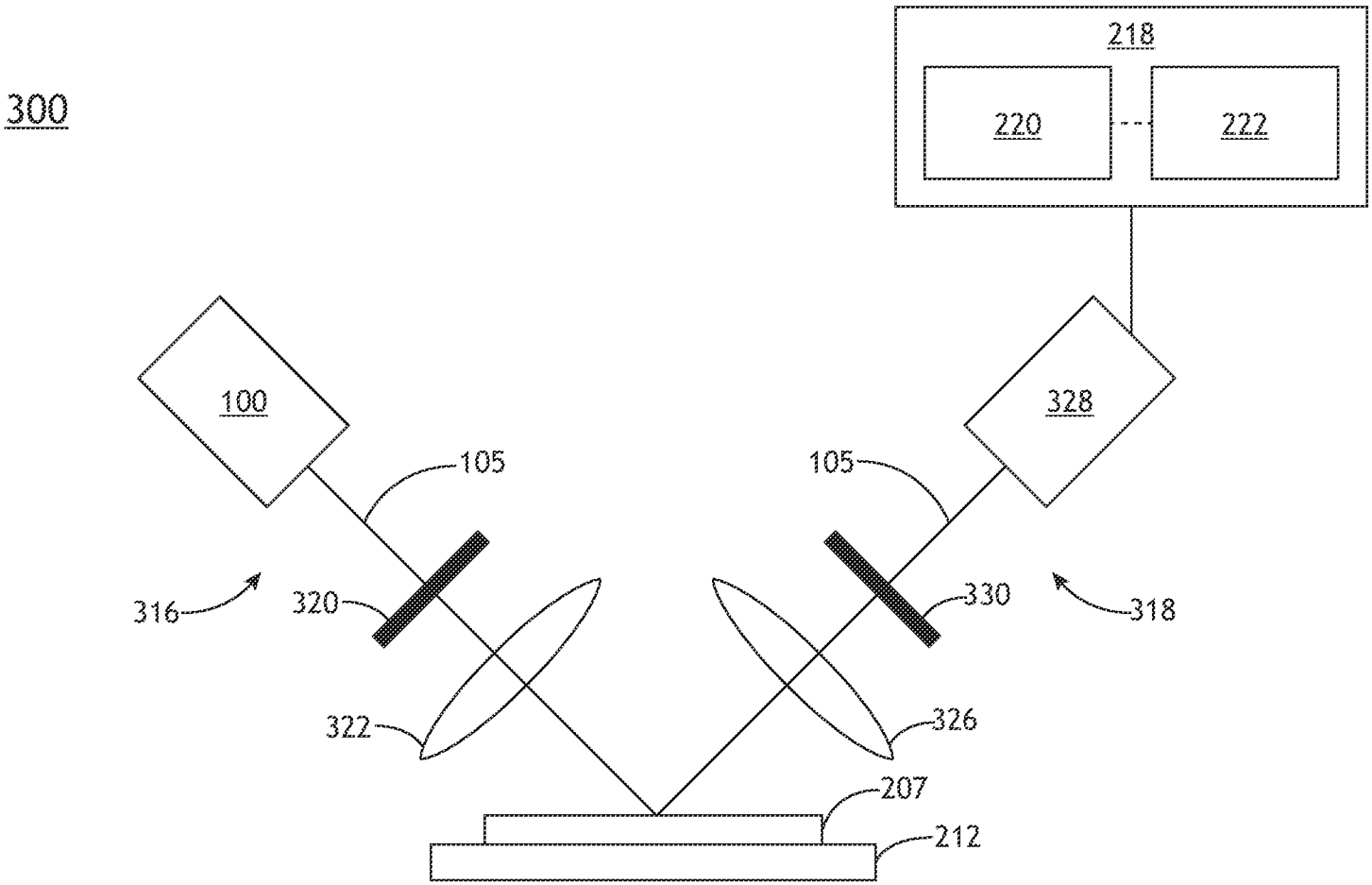
FIG. 3 illustrates a simplified schematic view of an optical characterization system implementing the LSP radiation source with one or more gas boosters, in accordance with one or more embodiments of the present disclosure.

FIG. 3 illustrates a simplified schematic diagram of an optical characterization system 300 arranged in a reflectometry and/or ellipsometry configuration, in accordance with one or more embodiments of the present disclosure. It is noted that the various embodiments and components described with respect to FIG. 2 may be interpreted to extend to the system of FIG. 3. The system 300 may include any type of metrology system known in the art.

In embodiments, system 300 includes the LSP radiation source 100, an illumination arm 316, a collection arm 318, a detector assembly 328, and the controller 218 including the one or more processors 220 and memory 222.

In this embodiment, the broadband radiation 105 from the LSP radiation source 100 is directed to the sample 207 via the illumination arm 316. In embodiments, the system 300 collects radiation emanating from the sample via the collection arm 318. The illumination arm pathway 316 may include one or more beam conditioning components 320 suitable for modifying and/or conditioning the broadband beam 105. For example, the one or more beam conditioning components 320 may include, but are not limited to, one or more polarizers, one or more filters, one or more beam splitters, one or more diffusers, one or more homogenizers, one or more apodizers, one or more beam shapers, or one or more lenses.

In embodiments, the illumination arm 316 may utilize a first focusing element 322 to focus and/or direct the beam 105 onto the sample 207 disposed on the sample stage 212. In embodiments, the collection arm 318 may include a second focusing element 326 to collect radiation from the sample 207.

In embodiments, the detector assembly 328 is configured to capture radiation emanating from the sample 207 through the collection arm 318. For example, the detector assembly 328 may receive radiation reflected or scattered (e.g., via specular reflection, diffuse reflection, and the like) from the sample 207. By way of another example, the detector assembly 328 may receive radiation generated by the sample 207 (e.g., luminescence associated with absorption of the beam 105, and the like). It is noted that detector assembly 328 may include any sensor and detector assembly known in the art. The sensor may include, but is not limited to, CCD detector, a CMOS detector, a TDI detector, a PMT, an APD, and the like.

The collection arm 318 may further include any number of collection beam conditioning elements 330 to direct and/or modify illumination collected by the second focusing element 326 including, but not limited to, one or more lenses, one or more filters, one or more polarizers, or one or more phase plates.

The system 300 may be configured as any type of metrology tool known in the art such as, but not limited to, a spectroscopic ellipsometer with one or more angles of illumination, a spectroscopic ellipsometer for measuring Mueller matrix elements (e.g., using rotating compensators), a single-wavelength ellipsometer, an angle-resolved ellipsometer (e.g., a beam-profile ellipsometer), a spectroscopic reflectometer, a single-wavelength reflectometer, an angle-resolved reflectometer (e.g., a beam-profile reflectometer), an imaging system, a pupil imaging system, a spectral imaging system, or a scatterometer.

A description of an inspection/metrology tools suitable for implementation in the various embodiments of the present disclosure are provided in U.S. Published Patent Application 2009/0180176, entitled "Split Field Inspection System Using Small Catadioptric Objectives," published on Jul. 16, 2009; U.S. Published Patent Application 2007/0002465, entitled "Beam Delivery System for Laser Dark-Field Illumination in a Catadioptric Optical System," published on Jan. 4, 2007; U.S. Pat. No. 5,999,310, entitled "Ultra-broadband UV Microscope Imaging System with Wide Range Zoom Capability," issued on Dec. 7, 1999; U.S. Pat. No. 7,525,649 entitled "Surface Inspection System Using Laser Line Illumination with Two Dimensional Imaging," issued on Apr. 28, 2009; U.S. Published Patent Application 2013/0114085, entitled "Dynamically Adjustable Semiconductor Metrology System," by Wang et al. and published on May 9, 2013; U.S. Pat. No. 5,608,526, entitled "Focused Beam Spectroscopic Ellipsometry Method and System, by Piwonka-Corle et al., issued on Mar. 4, 1997; and U.S. Pat. No. 6,297,880, entitled "Apparatus for Analyzing Multi-Layer Thin Film Stacks on Semiconductors," by Rosencwaig et al., issued on Oct. 2, 2001, which are each incorporated herein by reference in their entirety.

In embodiments, the LSP radiation source 100 and systems 200, 300 may be configured as a "stand alone tool," interpreted herein as a tool that is not physically coupled to a process tool. In other embodiments, such an inspection or metrology system, LSP radiation source 100 and systems 200, 300 may be coupled to a process tool (not shown) by a transmission medium, which may include wired and/or wireless portions. The process tool may include any process tool known in the art such as a lithography tool, an etch tool, a deposition tool, a polishing tool, a plating tool, a cleaning tool, or an ion implantation tool. The results of inspection or measurement performed by the systems described herein may be used to alter a parameter of a process or a process tool using a feedback control technique, a feedforward control technique, and/or an in-situ control technique. The parameter of the process or the process tool may be altered manually or automatically.

The embodiments of the LSP radiation source 100 and systems 200, 300 may be further configured as described herein. In addition, the LSP radiation source 100 and systems 200, 300 may be configured to perform any other step(s) of any of the method embodiment(s) described herein.

Figure 4:
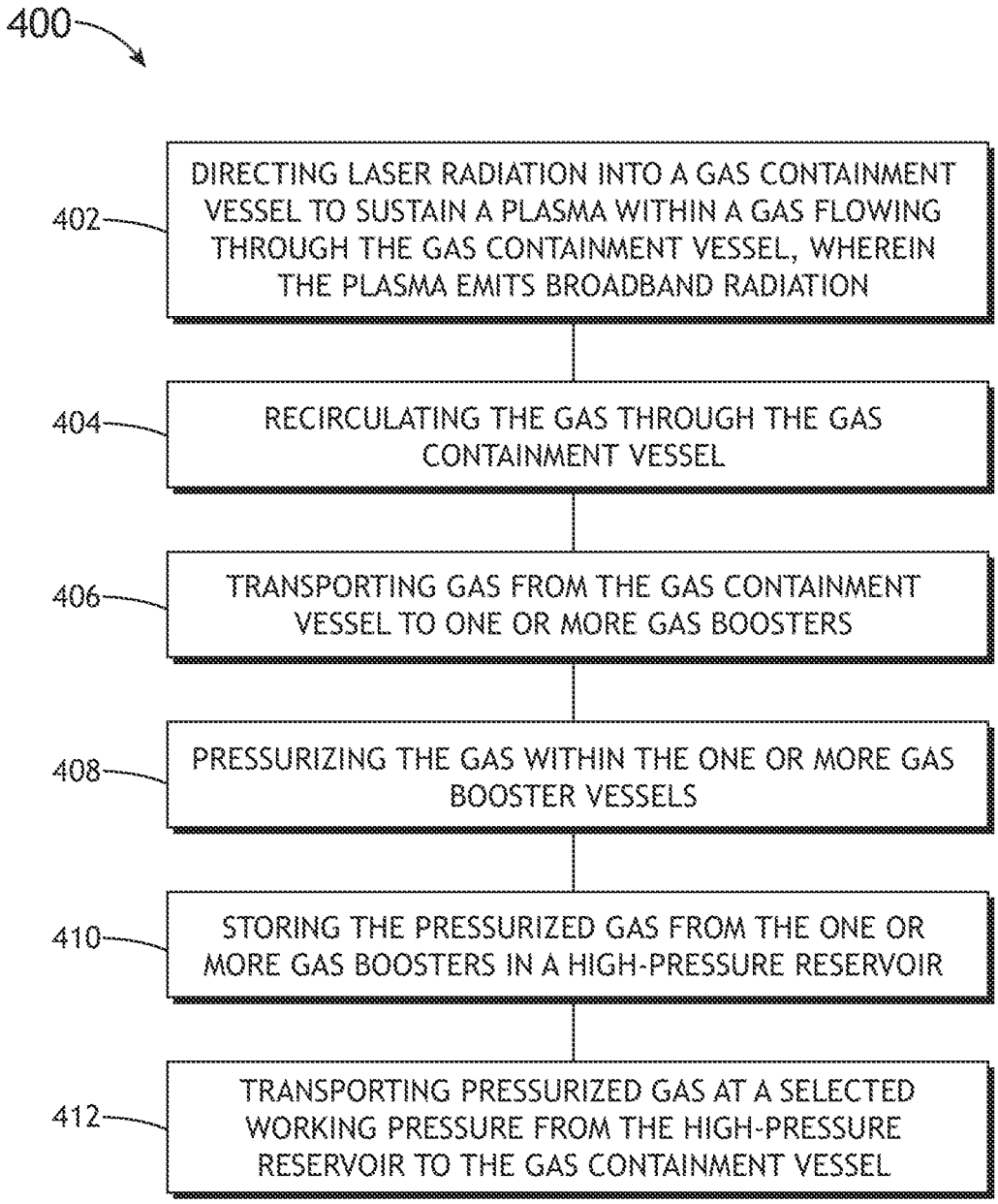
FIG. 4 illustrates a flow diagram depicting a method of generating flow in a recirculation gas loop of a LSP source, in accordance with one or more embodiments of the present disclosure.

FIG. 4 illustrates a flow diagram depicting a method 400 for generating broadband radiation, in accordance with one or more embodiments of the present disclosure. It is noted herein that the steps of method 400 may be implemented all or in part by LSP radiation source 100. It is further recognized, however, that the method 400 is not limited to the LSP radiation source 100 in that additional or alternative system-level embodiments may carry out all or part of the steps of method 400.

In step 402, laser radiation is directed into a gas containment vessel to sustain a plasma within a gas flowing through the gas containment vessel, wherein the plasma emits broadband radiation. In step 404, the gas is recirculated through the gas containment vessel via a recirculation gas loop. In step 406, gas from the gas containment vessel is transported to one or more gas boosters. In step 408, the gas is pressurized within the one or more gas boosters. In step 410, pressurized gas from the one or more gas boosters is stored in a pressurized gas reservoir. In step 412, pressurized gas is transported, at a selected working pressure, from the pressurized gas reservoir to the gas containment vessel.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken as limiting.

Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

The previous description is presented to enable one of ordinary skill in the art to make and use the invention as provided in the context of a particular application and its requirements. As used herein, directional terms such as "top," "bottom," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

All of the methods described herein may include storing results of one or more steps of the method embodiments in memory. The results may include any of the results described herein and may be stored in any manner known in the art. The memory may include any memory described herein or any other suitable storage medium known in the art. After the results have been stored, the results can be accessed in the memory and used by any of the method or system embodiments described herein, formatted for display to a user, used by another software module, method, or system, and the like. Furthermore, the results may be stored "permanently," "semi-permanently," temporarily," or for some period of time. For example, the memory may be random access memory (RAM), and the results may not necessarily persist indefinitely in the memory.

It is further contemplated that each of the embodiments of the method described above may include any other step(s) of any other method(s) described herein. In addition, each of the embodiments of the method described above may be performed by any of the systems described herein.

Embodiments of the present disclosure are directed to a buoyancy-driven closed recirculation gas loop for facilitating fast gas flow through an LSP radiation source. Advantageously, the LSP radiation source 100 of the present disclosure may include fewer mechanically actuated components than do previous approaches. Thus, the LSP radiation source 100 of the present disclosure may produce less noise, require smaller volumes of gas, and require lower maintenance costs and safety management.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A gas recirculation apparatus comprising:

a gas containment vessel configured to receive laser radiation from a pump source to sustain a plasma within gas flowed through the gas containment vessel, wherein the gas containment vessel is configured to transport gas from an inlet of the gas containment vessel to an outlet of the gas containment vessel, wherein the gas containment vessel is further configured to transmit at least a portion of broadband radiation emitted by the plasma;

a recirculation gas loop fluidically coupled to the gas containment vessel, wherein a first portion of the recirculation gas loop is fluidically coupled to the outlet of the gas containment vessel and is configured to receive the heated gas or a plume from the plasma from the outlet of the gas containment vessel;

one or more gas boosters, wherein the one or more gas boosters are fluidically coupled to the recirculation gas loop, wherein an inlet of the one or more gas boosters is configured to receive low pressure gas from the recirculation gas loop and wherein the one or more gas boosters are configured to pressurize the low-pressure gas into a high-pressure gas and transport the high-pressure gas to the recirculation gas loop via an outlet; and wherein a second portion of the recirculation gas loop is fluidically coupled to the inlet of the gas containment vessel and is configured to transport pressurized gas from the one or more gas boosters to the inlet of the gas containment vessel.

2. The gas recirculation apparatus of claim 1, further comprising:

a pressurized gas reservoir located between the one or more gas boosters and the gas containment vessel, wherein the pressurized gas reservoir is fluidically coupled to the outlet of the one or more gas boosters and is configured to receive and store high pressure gas from the one or more gas boosters.

3. The gas recirculation apparatus of claim 2, wherein a gas pressure in the pressurized gas reservoir varies above a working temperature of the gas containment vessel.

4. The gas recirculation apparatus of claim 2, further comprising:

a pressure regulator coupled to an outlet of the pressurized gas reservoir and configured to stabilize an output pressure of the pressurized gas reservoir and define a working pressure level of the gas containment vessel.

5. The gas recirculation apparatus of the claim 1, wherein the one or more gas boosters comprise one or more vessels.

6. The gas recirculation apparatus of claim 5, wherein one or more walls of the one or more vessels is maintained at a temperature below a temperature of gas at an intake of the one or more gas boosters.

7. The gas recirculation apparatus of claim 1, wherein the one or more gas boosters include one or more temperature control elements configured to generate a temperature difference between the gas within the one or more gas boosters and one or more walls of the one or more vessels of the one or more gas boosters.

8. The gas recirculation apparatus of claim 7, wherein the one or more temperature control elements comprise one or more heating elements.

9. The gas recirculation apparatus of claim 8, wherein the one or more heating elements comprise:

at least one of one or more metal wires, a metal grid, or a metal mesh configured for heating via an electrical current.

10. The gas recirculation apparatus of claim 8, wherein the one or more heating elements comprise:

a structure configured for heating via an external magnetic field.

11. The gas recirculation apparatus of claim 8, wherein the one or more heating elements comprise:

a set of electrodes configured for heating via electric arc discharge.

12. The gas recirculation apparatus of claim 8, wherein the one or more heating elements comprise:

an external optical device configured to focus light into the one or more gas boosters, wherein the external optical device comprises one or more lasers.

13. The gas recirculation apparatus of claim 8, wherein the one or more heating elements comprise:

an electromagnetic radiation source configured to transmit electromagnetic radiation into at least one of the one or more gas boosters, wherein an external optical device comprises one or more lasers.

14. The gas recirculation apparatus of claim 7, wherein the one or more temperature control elements comprise one or more cooling elements.

15. The gas recirculation apparatus of claim 1, wherein the one or more gas boosters include one or more agitators.

16. The gas recirculation apparatus of claim 1, wherein the one or more gas boosters comprises two or more gas boosters.

17. The gas recirculation apparatus of claim 16, wherein the two or more gas boosters are connected in parallel, wherein the two or more gas boosters comprise a first gas booster and a second gas booster fluidically coupled in parallel to the recirculation gas loop and configured to receive gas from the gas containment vessel.

18. The gas recirculation apparatus of claim 16, wherein each of the two or more gas boosters include one or more temperature control elements.

19. The gas recirculation apparatus of claim 18, wherein each of the two or more gas boosters include one or more heating elements.

20. The gas recirculation apparatus of claim 19, wherein the one or more heating elements are configured for ON/OFF cycling to periodically vary a temperature and a pressure of the pressurized gas from the two or more gas boosters.

21. The gas recirculation apparatus of claim 19, wherein at least one of the one or more heating elements comprise:

at least one of one or more metal wires, a metal grid, or a metal mesh configured for heating via an electrical current.

22. The gas recirculation apparatus of claim 19, wherein at least one of the one or more heating elements comprise:

a structure configured for heating via an external magnetic field.

23. The gas recirculation apparatus of claim 19, wherein at least one of the one or more heating elements comprise:

a set of electrodes configured for heating via electric arc discharge.

24. The gas recirculation apparatus of claim 19, wherein at least one of the one or more heating elements comprise:

an external optical device configured to focus light into at least one of the two or more gas boosters, wherein the external optical device comprises one or more lasers.

25. The gas recirculation apparatus of claim 19, wherein at least one of the one or more heating elements comprise:

electromagnetic radiation source configured to transmit electromagnetic radiation into at least one of the two or more gas boosters, wherein an external optical device comprises one or more lasers.

26. The gas recirculation apparatus of claim 18, wherein the one or more temperature control elements comprise one or more cooling elements.

27. The gas recirculation apparatus of claim 17, wherein each of the two or more gas boosters include one or more agitators.

28. The gas recirculation apparatus of claim 16, wherein the two or more gas boosters are connected in series, wherein the two or more gas boosters comprise a first gas booster and a second gas booster fluidically coupled in series to the recirculation gas loop, wherein the first gas booster is configured to receive gas from the gas containment vessel and wherein the second gas booster is configured to receive heated gas from the first gas booster.

29. The gas recirculation apparatus of claim 28, wherein each of the two or more gas boosters comprise:

an intake nozzle and an output nozzle, wherein the intake nozzle is at a lower temperature than the output nozzle.

30. The gas recirculation apparatus of claim 28, wherein each of the two or more gas boosters include one or more heating elements.

31. The gas recirculation apparatus of claim 30, wherein at least one of the one or more heating elements comprise:

at least one of one or more metal wires, a metal grid, or a metal mesh configured for heating via an electrical current.

32. The gas recirculation apparatus of claim 30, wherein at least one of the one or more heating elements comprise:

a structure configured for heating via an external magnetic field.

33. The gas recirculation apparatus of claim 30, wherein at least one of the one or more heating elements comprise:

a set of electrodes configured for heating via electric arc discharge.

34. The gas recirculation apparatus of claim 30, wherein at least one of the one or more heating elements element comprise:

an external optical device configured to focus light into at least one of the two or more gas boosters, wherein the external optical device comprises one or more lasers.

35. The gas recirculation apparatus of claim 30, wherein at least one of the one or more heating elements comprise:

an electromagnetic radiation source configured to transmit electromagnetic radiation into at least one of the two or more gas boosters, wherein the electromagnetic radiation source comprises one or more lasers.

36. The gas recirculation apparatus of claim 28, wherein each of the two or more gas boosters include one or more agitators.

37. The gas recirculation apparatus of claim 1, wherein the one or more recirculation gas loops comprise one or more closed recirculation gas loops.

38. The gas recirculation apparatus of claim 1, wherein the gas containment vessel comprises:

at least one of a plasma lamp, a plasma cell, or a plasma chamber.

39. The gas recirculation apparatus of claim 1, wherein the one or more recirculation gas loops is configured to flow at least one of argon, xenon, neon, nitrogen, krypton, or helium through the gas containment vessel.

40. The gas recirculation apparatus of claim 39, wherein the one or more recirculation gas loops is configured to flow a mixture of two or more gases.

41. A broadband light source comprising:

a pump source configured to generate laser radiation;

a gas containment vessel configured to receive the laser radiation from the pump source to sustain a plasma within gas flowed through the gas containment vessel, wherein the gas containment vessel is configured to transport gas from an inlet of the gas containment vessel to an outlet of the gas containment vessel;

a set of collection optics configured to receive broadband radiation emitted by the plasma sustained within the gas containment vessel; and a recirculation gas loop fluidically coupled to the gas containment vessel, wherein a first portion of the recirculation gas loop is fluidically coupled to the outlet of the gas containment vessel and is configured to receive heated gas or a plume from the plasma from the outlet of the gas containment vessel;

one or more gas boosters, wherein the one or more gas boosters are fluidically coupled to the recirculation gas loop, wherein an inlet of the one or more gas boosters is configured to receive low pressure gas from the recirculation gas loop and wherein the one or more gas boosters are configured to pressurize the low-pressure gas into a high-pressure gas and transport the high-pressure gas to the recirculation gas loop via an outlet; and wherein a second portion of the recirculation gas loop is fluidically coupled to the inlet of the gas containment vessel and is configured to transport pressurized gas from two or more gas boosters to the inlet of the gas containment vessel.

42. The broadband light source of claim 41, wherein the pump source comprises:

at least one of a pulsed laser, a continuous wave (CW) laser, a pseudo-CW laser, or a modulated CW laser.

43. An optical characterization system comprising:

a broadband radiation source, wherein the broadband radiation source comprises:

a pump source configured to generate laser radiation;

a gas containment vessel configured to receive the laser radiation from the pump source to sustain a plasma within gas flowed through the gas containment vessel, wherein the gas containment vessel is configured to transport gas from an inlet of the gas containment vessel to an outlet of the gas containment vessel;

a set of collection optics configured to receive broadband radiation emitted by the plasma sustained within the gas containment vessel;

a recirculation gas loop fluidically coupled to the gas containment vessel, wherein a first portion of the recirculation gas loop is fluidically coupled to the outlet of the gas containment vessel and is configured to receive heated gas or a plume from the plasma from the outlet of the gas containment vessel;

one or more gas boosters, wherein the one or more gas boosters are fluidically coupled to the recirculation gas loop, wherein an inlet of the one or more gas boosters is configured to receive low pressure gas from the recirculation gas loop and wherein the one or more gas boosters are configured to pressurize the low-pressure gas into a high-pressure gas and transport the high-pressure gas to the recirculation gas loop via an outlet; and wherein a second portion of the recirculation gas loop is fluidically coupled to the inlet of the gas containment vessel and is configured to transport pressurized gas from the one or more gas boosters to the inlet of the gas containment vessel; and a set of characterization optics configured to collect a portion of the broadband radiation from the set of collection optics of the broadband radiation source, and direct the broadband radiation onto a sample, wherein the set of characterization optics is further configured to direct radiation from the sample to a detector assembly.

44. The optical characterization system of claim 43, wherein the optical characterization system is configured as an inspection system.

45. The optical characterization system of claim 43, wherein the optical characterization system is configured as a metrology system.

46. A method comprising:

directing laser radiation into a gas containment vessel in order to sustain a plasma within a gas flowing through the gas containment vessel, wherein the plasma emits broadband radiation; and recirculating the gas through the gas containment vessel via a recirculation gas loop, wherein the recirculating the gas through the gas containment vessel comprises:

transporting gas from an outlet of the gas containment vessel to an inlet of one or more gas booster assemblies;

pressurizing the gas within the one or more gas boosters;

storing the pressurized gas from an outlet of the one or more gas boosters within a pressurized gas reservoir; and transporting pressurized gas at a selected working pressure from the pressurized gas reservoir to the gas containment vessel.

* * * * *